United States Patent [19]

Lin

[11] Patent Number: 5,054,216

[45] Date of Patent: Oct. 8, 1991

[54] KIND OF LEISURE SHOES

[76] Inventor: Kuo-Yang Lin, No. 601, Chung Cheng Road, Tsao Tun Chen, Nantou Hsien, Taiwan

[21] Appl. No.: 511,368

[22] Filed: Apr. 19, 1990

[51] Int. Cl.[5] ..... A43B 11/00

[52] U.S. Cl. ..... 36/138; 36/58.5

[58] Field of Search ..... 36/58.5, 58.6, 138, 36/1, 28, 105, 107, 108, 68, 80, 82

[56] References Cited

U.S. PATENT DOCUMENTS

| | | | |
|---|---|---|---|
| 71,095 | 11/1867 | Weidenman | 36/58.6 |
| 1,464,342 | 8/1923 | Rothacher | 36/58.5 |
| 1,686,175 | 10/1928 | Read | 36/58.5 |
| 2,446,777 | 8/1948 | Menenka | 36/138 |
| 2,736,110 | 2/1956 | Hardimon | 36/58.5 |
| 3,117,385 | 1/1964 | Evans | 36/138 |
| 3,146,535 | 9/1964 | Owings | 36/58.6 |
| 3,261,114 | 7/1966 | Saunders | 36/138 |
| 3,400,474 | 9/1968 | Tendler | 36/58.5 |
| 4,361,969 | 12/1982 | Vermonet | 36/29 |
| 4,760,651 | 8/1988 | Pon-Feu | 36/138 |

*Primary Examiner*—Steven N. Meyers
*Attorney, Agent, or Firm*—Browdy and Neimark

[57] ABSTRACT

A kind of leisure shoes of which the backs of the uppers will automatically recover their upright position when users completely extend their feet into the shoes. A deformable and stretch element is contained in a tunnel-like chamber hiddenly formed in the middle layer of each sole and extending from the front portion of the sole toward the rear portion thereof. The stretch element may protrude out the rear sole through an opening formed at the surface and extends into the back of the shoe's upper. An elastic means is contained in a cavity formed in the sole below the front portion of the tunnel-like chamber. The upward stretch or the downward compression of the elastic means will cause the stretch element above it to be pulled forward or be pushed backward, respectively, and in turn causes the rear end of the stretch element contained in the back to automatically move down or up, respectively.

3 Claims, 4 Drawing Sheets

KIND OF LEISURE SHOES

BACKGROUND OF THE INVENTION

The main parts of shoes generally include a sole and an upper for sufficiently covering and confining a foot. The upper is usually further divided into several different portions, namely, vamp, tongue, sides, throat, and back.

Athletic shoes and leisure shoes which are presently popular are extremely soft and are designed to provide users with convenience and comfort. However, such shoes with the above-mentioned structure do not permit users to conveniently and quickly put on the shoes. It is because the user's heel will step on and press down the back of the upper of a shoe when the shoes are put on and the back is so soft that it can not automatically recover its original position and shape without help from the user with his finger or with a shoe lifter.

Moreover, the backs of most uppers of shoes have a defined shape after they are formed which may not absolutely conform with the shape and size of the user's heel and, consequently, can not provide the user with comfort and adequate protection while the user's heel can not be fitted and steadily confined in the shoes. Since it is sometimes possible that users have two feet with different sizes, a pair of shoes with both shoes of the same size shall particularly tend to worsen the above said problem.

Therefore the applicant has tried to develop a kind of shoes which may eliminate those shortcomings of present leisure shoes and athletic shoes.

SUMMARY OF THE INVENTION

The primary object of the present invention is to provide a kind of leisure shoe, the backs of which may automatically recover an upright position and fit in contact with the user's heels after they are put on.

A further object of the present invention is to provide a kind of leisure shoes the backs of which may fit and cover and attach to a user's heel upon receiving a downward force from the heel of a user, so that the user's feet will not be unsteady and slip about in the shoes.

A still further object of the present invention is to provide a kind of leisure shoe, of which the back of the upper has a stretch element with proper elasticity allowing freely curving and deformation, which is hidden therein to aid the fit and comfortable attachment of the back to the heel of the user.

The present invention is characterized by a tunnel-like chamber provided in the sole and extending from the front section of the sole to the rear top of the back through an opening formed on the rear end surface of the sole; a cavity provided in the sole beneath the front portion of the tunnel-like chamber for containing an elastic element therein; and a stretch element contained in the tunnel-like chamber with its front end fixed in place at the front end of the tunnel-like chamber and its rear end extending through the opening on the rear end of the sole into the back of the shoes. Following the stretch or compression of the elastic element in the cavity, the stretch element is pulled forward or stretched backward which may cause the back of the shoes to move down or up.

The elastic element as mentioned above is generally a tension spring or any ball-like object having compressibility, or any other means of equivalent function.

The stretch element as mentioned is strip-shaped and is capable of freely curving and deforming.

BRIEF DESCRIPTION OF THE DRAWINGS

The detailed structure of the present invention and the functions and benefits thereof may become apparent by referring to the embodiment of the invention described in the accompanying description and illustrated in the accompanying drawings, in which.

DETAILED DESCRIPTION OF THE PREFERRED EMBODIMENT

Figure 1:
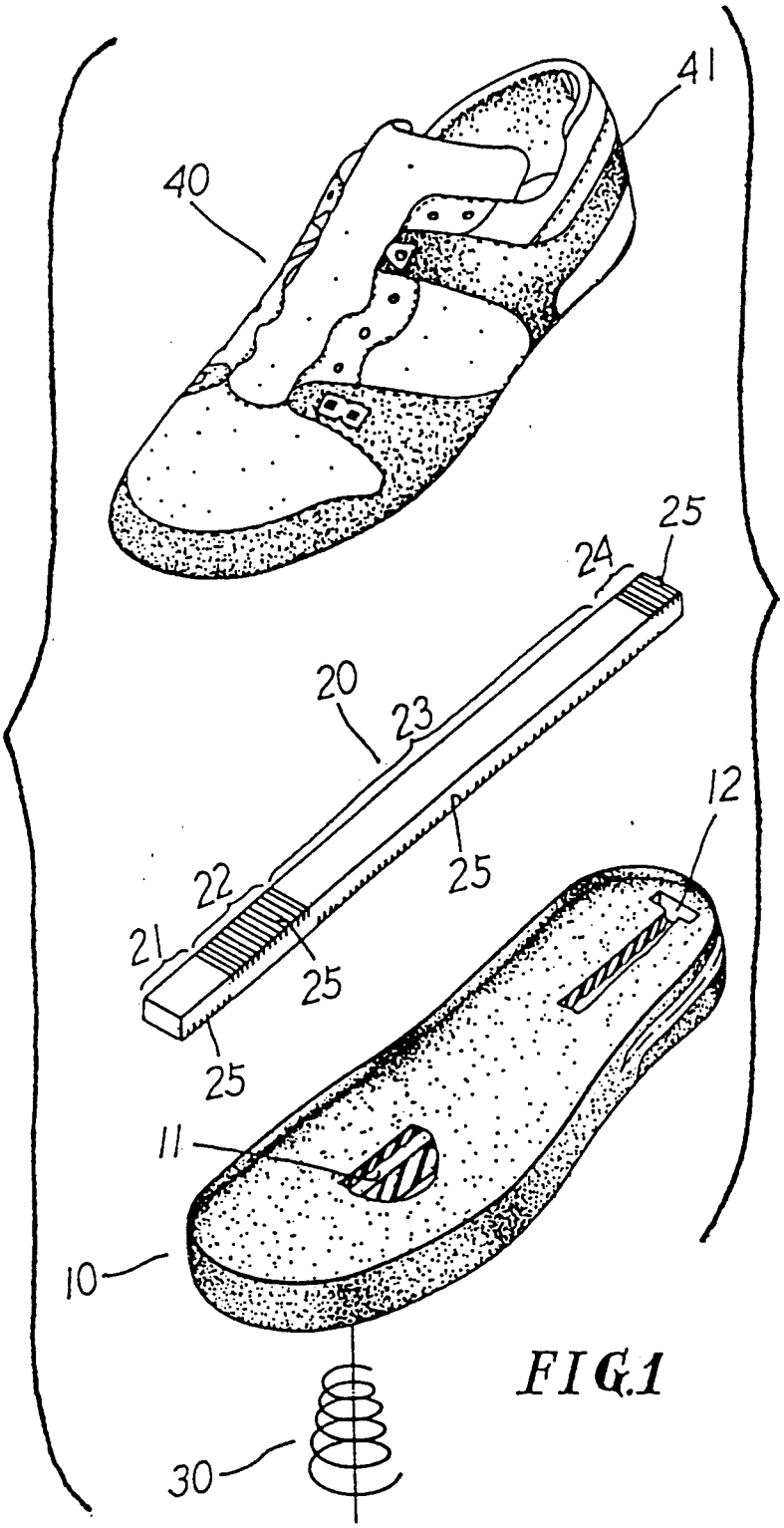
FIG. 1 is a three-dimensional analytical perspective of the invention.

Referring to FIG. 1, each of the leisure shoes of the present invention consists of a sole 10 having a stretch element 20 and a elastic element 30 hiddenly contained therein, and an upper 40 of the shoe.

In the middle layer of the sole 10, a tunnel-like elongate chamber 11 is formed to extend from the front portion of the sole toward the rear portion thereof, and gradually runs upward when it reaches close to the rear portion of the sole, and finally, it comes out of the rear portion of the sole to form an opening 12 thereon allowing the stretch element 20 to be put in a tunnel-like chamber 11 through there. Moreover, a cavity 13, shown in FIGS. 2–5, is provided in the front portion of the sole 10 beneath the front end of the tunnel-like chamber 11.

The stretch element 20 is strip-shaped, flat, and capable of freely curving and deforming. It can be further divided into four sections, namely, front sections 21, mid-front section 22, mid-rear section 23, and rear section 24. A plurality of parallel and equi-spaced slits 25 are formed on the upper surfaces of the mid-front and the rear sections 22 and 24 and on the lower surfaces of the front and the mid-rear sections 21 and 23. The front section 21 of the stretch element 20 is fixedly attached to the front portion of the tunnel-like chamber 11; the mid-front section 22 is located at a position corresponding to the cavity 13; the rear part of the mid-rear section 23 forms the lower and the upper segments nearby the opening 12 on the sole 10; and the rear section 24 is the portion extending and protruding out of the opening 12 as shown in FIG. 2.

Figure 2:
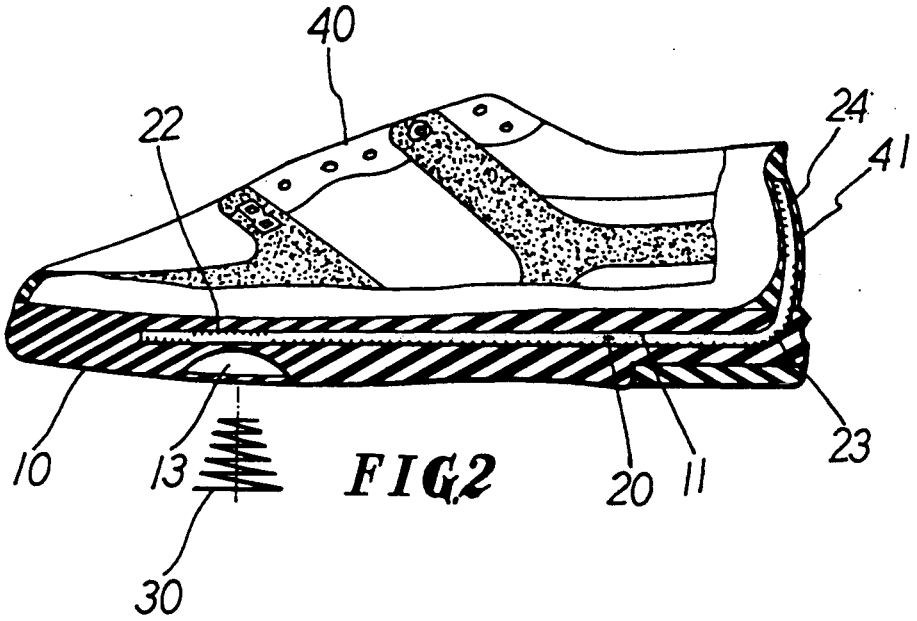
FIG. 2 is a partially cross sectioned elevational view of the invention showing the assembly of parts thereof, wherein the cavity is pressed down and the rear end of the stretched element is stretched backward and upward.
Figure 3:
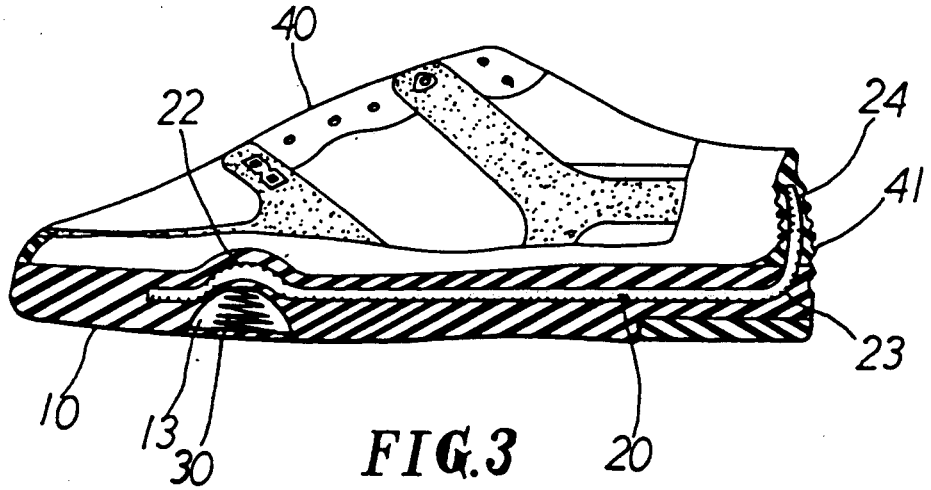
FIG. 3 is another partially cross sectioned elevational view of the present invention showing the cavity which is protruded and the stretch element pulled forward and causing the back of the shoes to move down.
Figure 2A:
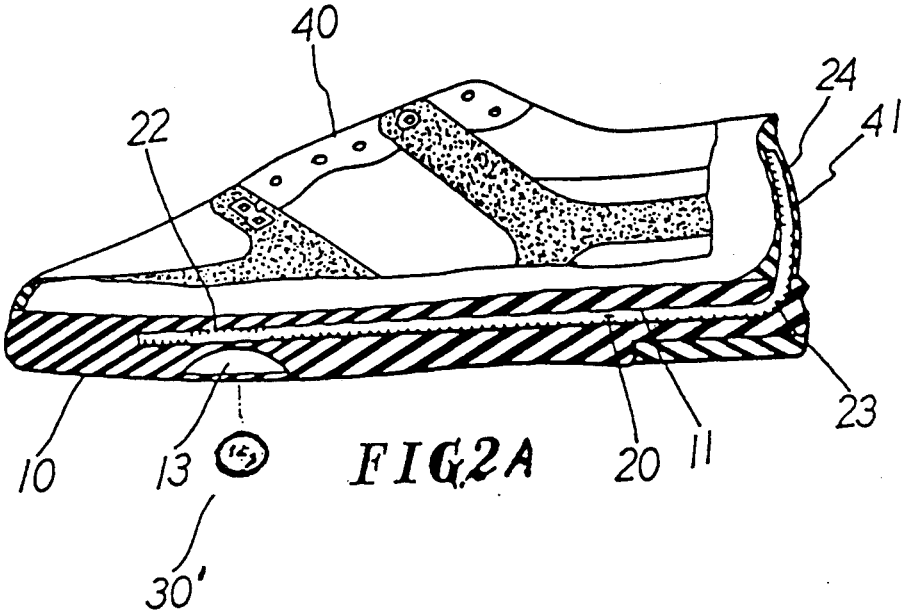
FIGS. 2A and 3A are similar views to FIGS. 2 and 3 with a different form of elastic element.
Figure 3A:
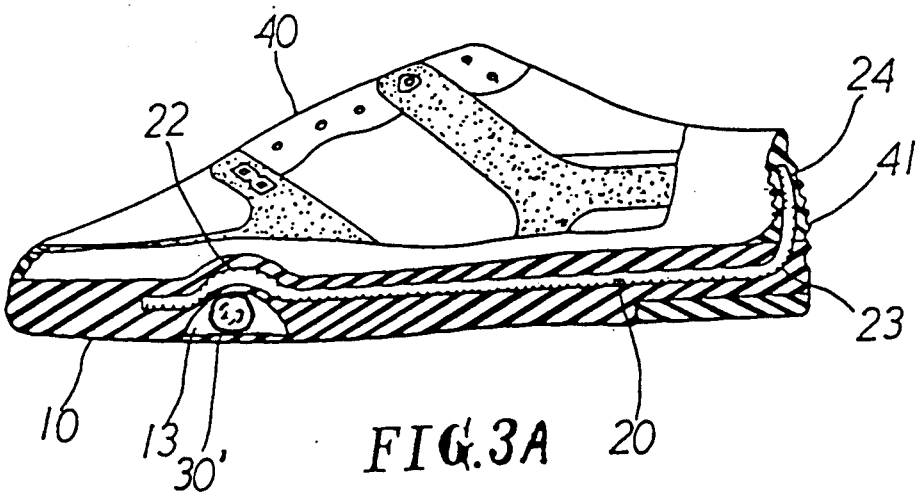

The elastic element 30 is preferably a tension spring, but a ball-shaped object 30' as shown in FIGS. 2A and 3A having compressibility and elasticity is also acceptable. This element is contained in the cavity 13 of the sole 10 (see FIG. 3) and may lift upwardly a portion of sole 10 and the stretch element 20, just above the top of the elastic element 30, by its stretch force. The lifted sole 10 and stretch element 20 are deformed to a curve, particularly the mid-front sections 22 of the stretch element 20 is upwardly arched and pulls the mid-rear and the rear sections 23, 24 to shift forward and makes the rear section 24 move downward.

The upper 40 of the shoe is joined to the top periphery of the sole 10 with the mid-rear and the rear sections 23, 24 of the stretch element 20 enclosed in the back 41 thereof, as shown in FIGS. 2 and 3. In this way, the back 41 may be brought to shift up and down by the deformation of the stretch element 20.

Figure 4:
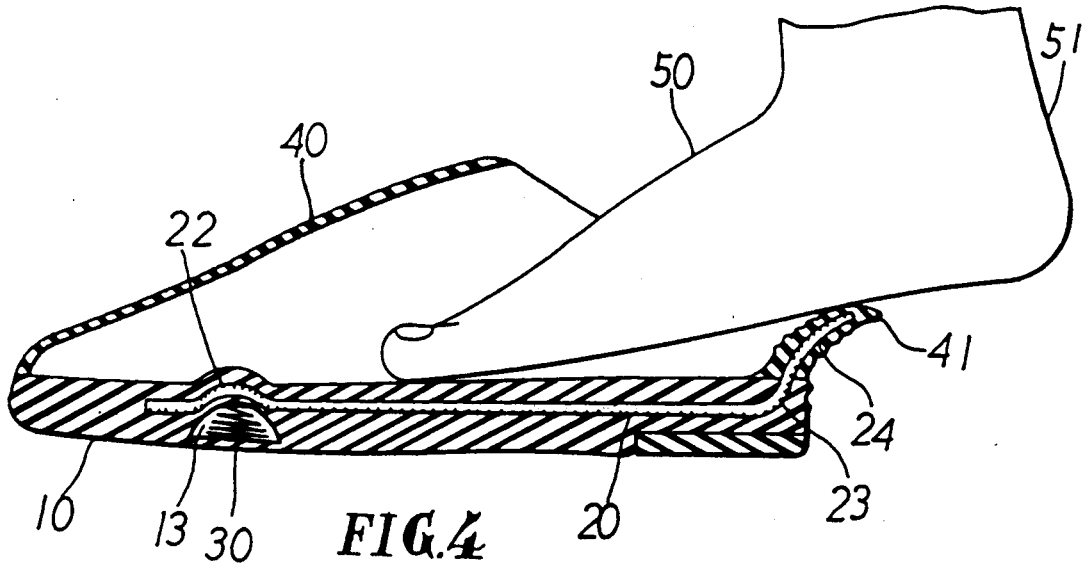
FIG. 4 and FIG. 5 are cross sectioned elevational views of the invention illustrating a man's foot moving into a shoe of the invention and how the shoe functions.
Figure 5:
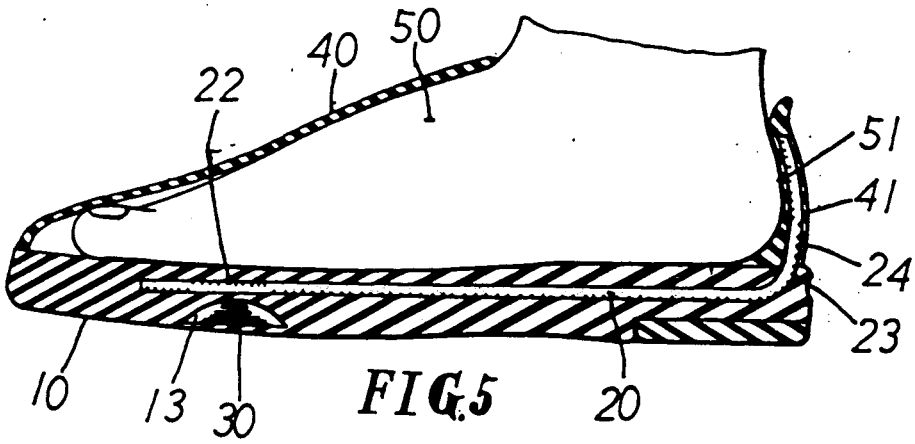

When the leisure shoes of the present invention are not in use, the mid-front section 22 of the stretch element 20 contained in the tunnel-like chamber 11 will be arched upward by the tension of the elastic element 30 contained in the cavity 13. The mid-rear and the rear sections 23, 24 of the stretch element 20 will shift toward the front section 21, accordingly, and the back 41 of the upper 40 which encloses the rear section 24 will therefore be dragged downward by the rear section 24 of the stretch element 20 as shown in FIG. 3. When a user extends his or her foot 50 into a leisure shoe of the present invention, his or her heel will initially press down the back 41 of the shoe as shown in FIG. 4; later, when the foot 50 completely extends into the show and steps down, the originally upwardly arched portion of the stretch element 20 as well as the elastic element 30 in the cavity 13 as shown in FIG. 5, and the heel 51 of the user, is completely received in the back 41 of the upper 40, the mid-front section 22 of the stretch element 20 having been stepped down will pull the mid-rear and the rear sections 23, 24 of the stretch element 20 to shift backward, that is, the rear section 24 will cause the back 41 to move upward to cover the heel 51 automatically. Thus, the back of a shoe may automatically recover its upright position after a foot is completely extended into the shoe without any other aids or movement.

Further, since the mid-rear section 23 of the stretch element 20 may deform by following the arch formed at the rear portion of the tunnel-like chamber 11, and the mid-rear section 23 itself has a bend-inward characteristic, section 23 will always fit to heel 51 to attach and support the heel 51, so that the heel 51 will not be loosely and, consequently, uncomfortably covered by the back 41.

Moreover, since the opening 12 formed on the rear portion of the sole 10 to allow the rear section 24 of the stretch element 20 to protrude into the back 41 is open upward, the heel 51 will transmit a lifting force when the whole foot 50 is completely in place. The back 41 and the rear section 24 of the element 20 will receive a lift force transmitted from the heel 51 which causes the rear section 24 of the stretch element 20 to bring the whole back 41 into position to cover the heel 51 which further helps the foot be steadily confined in the shoe.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

I claim:

1. Shoes of the type wherein each shoe comprises a sole having a front portion, a rear portion forming a heel portion, a middle layer, and an upper surface in connecting relation to each other;

a tunnel-like elongate chamber in said middle layer of said sole, and having a front end from which it extends from said front portion of said sole toward said rear portion of said sole, gradually elevating in a curve as it extends and reaches close to said rear portion of said sole and forming an opening in said upper surface of said sole in said rear portion;

an upwardly arched cavity formed in said sole beneath said elongate chamber in said front portion of said sole;

an elastic element contained in said upwardly arched cavity;

a strip-shaped stretch element in said tunnel-like elongate chamber with said stretch element having front and rear sections, and said stretch element fixedly attached to said front end of said tunnel-like elongate chamber;

said stretch element having a plurality of parallel and equi-spaced slits on its surface to facilitate its deformation following stretch and compression respectively of said elastic element in said cavity in said sole;

an upper having a back which joins with said sole at said heel portion, enclosing said rear section of said stretch element protruding out of said opening in said upper surface of said sole with said upper back connected to said stretch element;

said back movable downward when said rear section of said stretch element is pulled toward said front portion of said sole by an upward protrusion of said front section of said stretch element caused by said elastic element in said cavity in said sole below said front portion of said tunnel-like chamber;

said back automatically moving upward when said rear section of said stretch element in said back is pushed upward due to compression of said elastic element in said cavity and hence backward stretch of said stretch element.

2. The shoe in accordance with claim 1 wherein said elastic element is a tension spring.

3. The shoe in accordance with claim 1 wherein said elastic element is a ball object having compressibility and elasticity.

* * * * *